US005647764A

United States Patent [19]

Kimura

[11] Patent Number: 5,647,764

[45] Date of Patent: Jul. 15, 1997

[54] HOLDER-CONTAINING CONNECTOR

[75] Inventor: Tomohiko Kimura, Shizuoka, Japan

[73] Assignee: Yazaki Corporation

[21] Appl. No.: 688,091

[22] Filed: Jul. 29, 1996

[30] Foreign Application Priority Data

Jul. 31, 1995 [JP] Japan ..... 7-195416

[51] Int. Cl.[6] ..... H01R 13/40

[52] U.S. Cl. ..... 439/595

[58] Field of Search ..... 439/595, 752

[56] References Cited

U.S. PATENT DOCUMENTS

| | | | |
|---|---|---|---|
| 5,088,938 | 2/1992 | Murakami et al. | 439/595 |
| 5,209,676 | 5/1993 | Endo et al. | 439/752 |
| 5,256,083 | 10/1993 | Yamamoto | 439/752 |

FOREIGN PATENT DOCUMENTS 3-1463 1/1991 Japan .

*Primary Examiner*—Gary F. Paumen
*Assistant Examiner*—T. C. Patel
*Attorney, Agent, or Firm*—Armstrong, Westerman, Hattori, McLeland & Naughton

[57] ABSTRACT

A holder-containing type connector according to the present invention is composed in such a manner that it comprises a connector housing having a resilient locking lance for locking a terminal inserted therein, and a holder having a deflection prohibiting member which can move into a deflection absorbing space for allowing the resilient locking lance to deflect therein, and insertable into the connector housing, wherein the holder is composed of: a pair of mutually facing plates each having the deflection prohibiting member, which pair of plates being connected by a pair of resilient sections, and urged thereby in the direction parting from each other, and the connector housing comprises: a pair of first and second guide walls each abutting against an external surface of each of the pair of plates, wherein a distance between the pair of plates is made longer than that between the guide walls. The holder-containing connector with the above structure can realize a secure locking of the terminal in the connector housing, and also an easy and comfortable installation of the holder.

3 Claims, 5 Drawing Sheets

HOLDER-CONTAINING CONNECTOR

BACKGROUND OF THE INVENTION

1. Field of the Invention

The present invention relates to a holder-containing connector which is capable of prohibiting a deflection of a resilient locking lance provided for locking a connector terminal in the housing, and also capable of improving a secure locking of the terminal and detection of an improper halfway insertion of the terminal.

2. Description of the Prior Art

FIGS. 6 and 7 show a conventionally used holder-containing connector as disclosed in Japanese Patent Application Laid-Open No. Heisei 3-1463.

In the figures, a holder-containing connector 41 is composed of a male connector housing 44 having a connector receiving section 43 inside a hood section 42 thereof, and a front holder 45 which is to be inserted into the connector receiving section 43 from the front side thereof. The front holder 45 includes a preliminary locking projection 47 to be fitted with an inner wall 46 of the connector receiving section 43 and a locking projection 49 to be fitted with a female terminal 48 (in FIG. 7) held within the connector receiving section 43. The locking projection 49 is provided on a resilient plate 50, and can be fitted in a locking hole of the terminal 48.

The front holder 45 is inserted into the connector housing 44, and is pushed outward from its preliminary locked position by an insertion of the terminal 48, as disclosed in FIG. 7, so that the rear end 48*a* of the terminal 48 is fitted with the rear protrusion 52 of the terminal accommodating chamber 51 and the terminal 48 is pushed up by a resilient arm 53 at the same time. When, from this situation, the holder 45 is again pushed in, the resilient plate 50 is deflected and the locking projection 49 thereof is fitted with the terminal 48 to be locked thereby. Here, in case the terminal 48 is not in the fully inserted state, as shown in FIG. 7 again, if the holder 45 is pushed in, the terminal 48 is rearwardly pushed, whereby it is detected that the terminal is in an imperfectly inserted state.

However, the structure of the above-mentioned conventional type holder-containing connector has been made more complicated year by year with a recent trend for minimization of connectors and/or addition of preliminary and secondary locking projections and so on, so that a fitting tolerance between the connector housing 44 and the holder 45 is made larger and the holder becomes unstable, whereby even in the event that the terminal 48 is not fully inserted, the far end of the arm 50 of the holder 45 cannot be readily abutted against the front end of the terminal 48. On the other hand, there has also been a case that the tolerance between the connector housing 44 and the holder 45 is made extremely small, thereby making it difficult to insert the holder 45.

The present invention is made for solving the above problem, and it is an object of the present invention to provide a holder-containing connector which is capable of realizing a secure locking of the terminal, and also an easy and comfortable insertion of the holder, by eliminating a variation in the dimensions of each holder with respect to the connector housing.

SUMMARY OF THE INVENTION

In order to accomplish the above object, a holder-containing type connector according to the present invention is composed in such a manner that it comprises a connector housing having a resilient locking lance for locking a terminal inserted therein, and a holder having a deflection prohibiting member which can move into a deflection absorbing space for allowing the resilient locking lance to deflect therein, and insertable into the connector housing, wherein the holder is composed of: a pair of mutually facing plates each having the deflection prohibiting member, which pair of plates being connected by a pair of resilient sections, and urged thereby in the direction parting from each other, and the connector housing comprises: a pair of first and second guide walls each abutting against an external surface of each of the pair of plates, wherein a distance between the pair of plates is made longer than that between the guide walls.

Further, it is possible to construct such that each of the pair of plates is formed with a groove for receiving the resilient lance, and the resilient lance can move into the groove when the holder is in a semi-engaged state with the connector housing, and is set adjacent the deflection prohibiting member while the holder is in a fully engaged state with the housing.

Due to the above construction, the holder-containing connector of the present invention functions as below.

When the holder is inserted into the connector housing, the resilient section thereof is deflected, thereby to abut the pair of vertically aligned plates against the respective guide walls by a recovering force of the resilient section, and due to this movement, the holder is securely fixed within the connector housing, and simultaneously a gap between the resilient locking lance and the deflection prohibiting member of the plate is regulated to be constantly rather small. In addition, by inserting a connector terminal into the housing with the holder being fitted halfway, the resilient locking lance is deflected into the receiving groove, and thereafter recovered to lock the terminal.

Other features and advantages of the invention will be apparent from the following description taken in connection with the accompanying drawing.

DETAILED DESCRIPTION OF THE PREFERRED EMBODIMENTS

In the above-explained conventional type holder-containing connector, the resilient arm of the connector housing only pushes up the terminal toward the locking protrusion. However, the holder-containing connector according to the present invention is constructed such that the terminal is locked by a resilient locking lance instead of the resilient arm as a preliminary locking and also locked by the holder as a secondary locking.

In the following, one embodiment of the present invention is explained with reference to the attached drawings.

Figure 1:
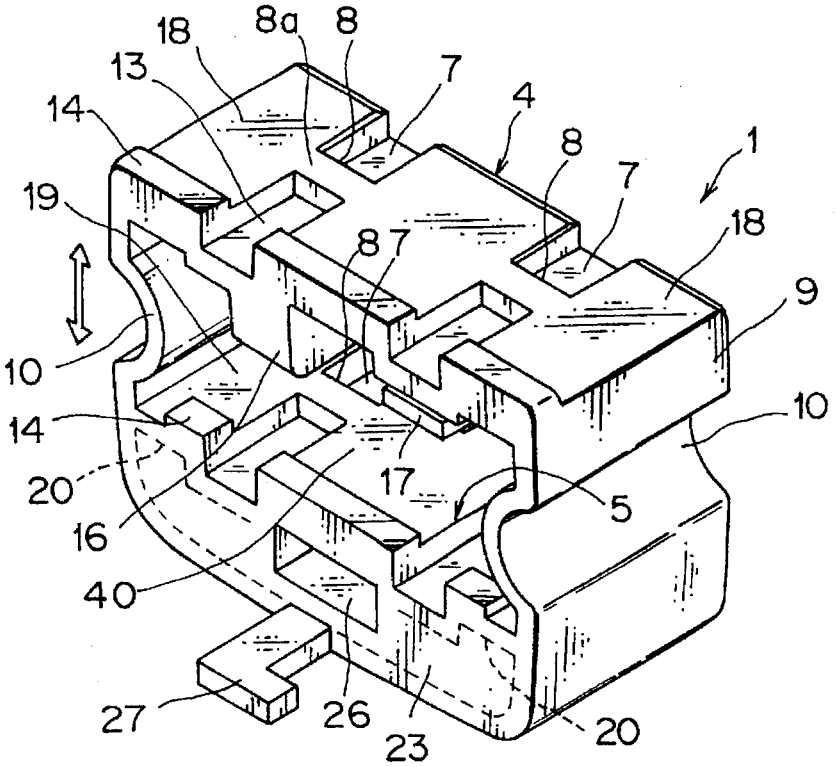
FIG. 1 is a perspective view showing one embodiment of a holder for use in a holder-containing connector according to the present invention.
Figure 2:
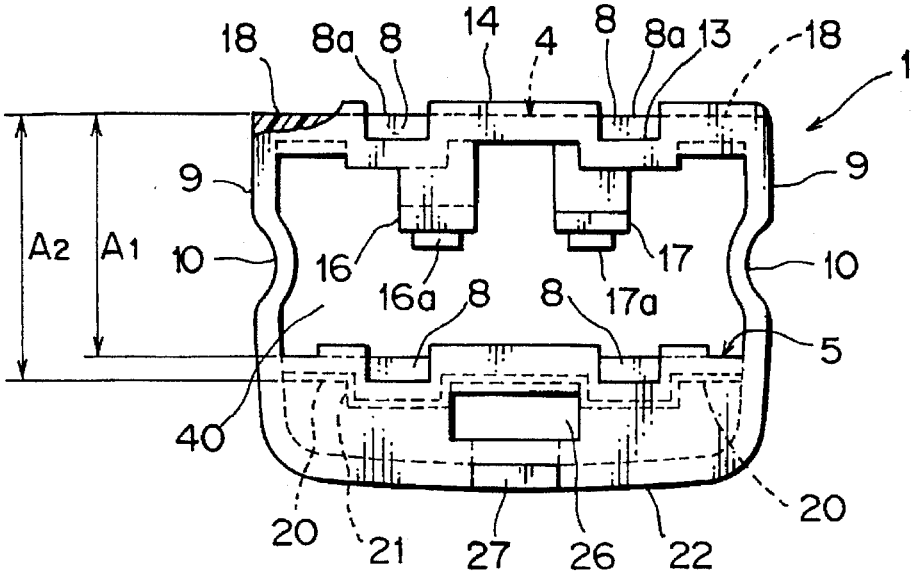
FIG. 2 is a front view of the holder of FIG. 1.
Figure 3:
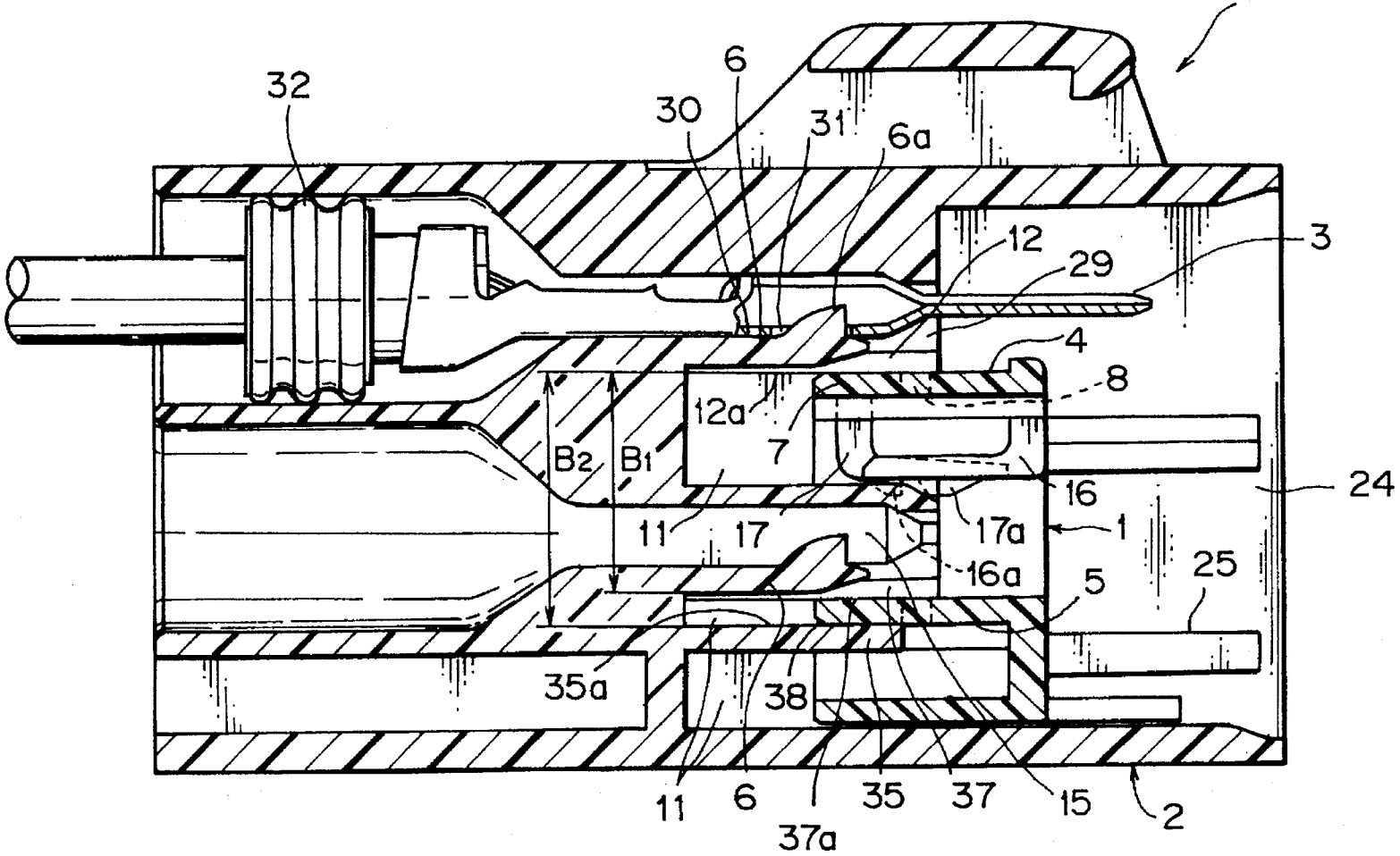
FIG. 3 shows one embodiment of a holder-containing connector, and is a longitudinal sectional view in which the holder is preliminarily locked within the connector housing.
Figure 4:
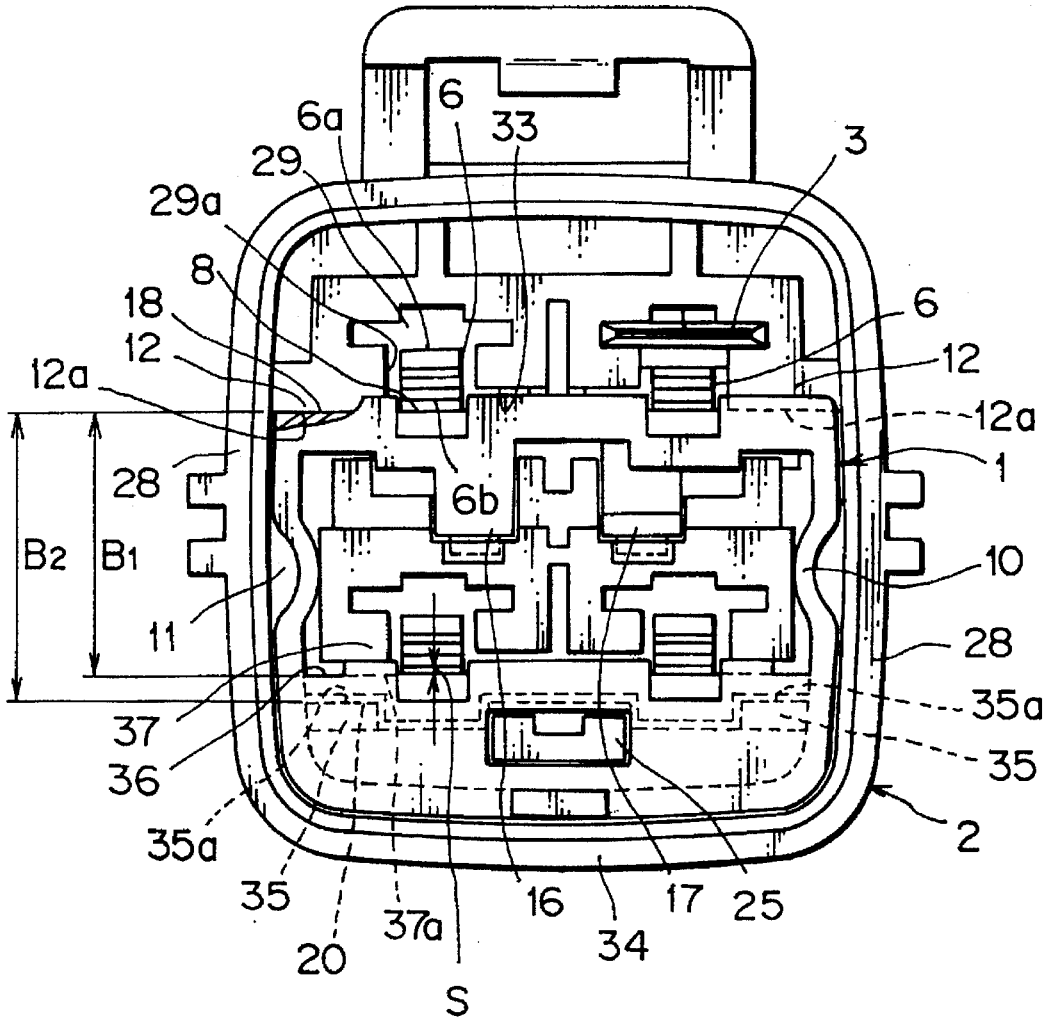
FIG. 4 is a front view in which the holder is set within the connector housing.
Figure 5:
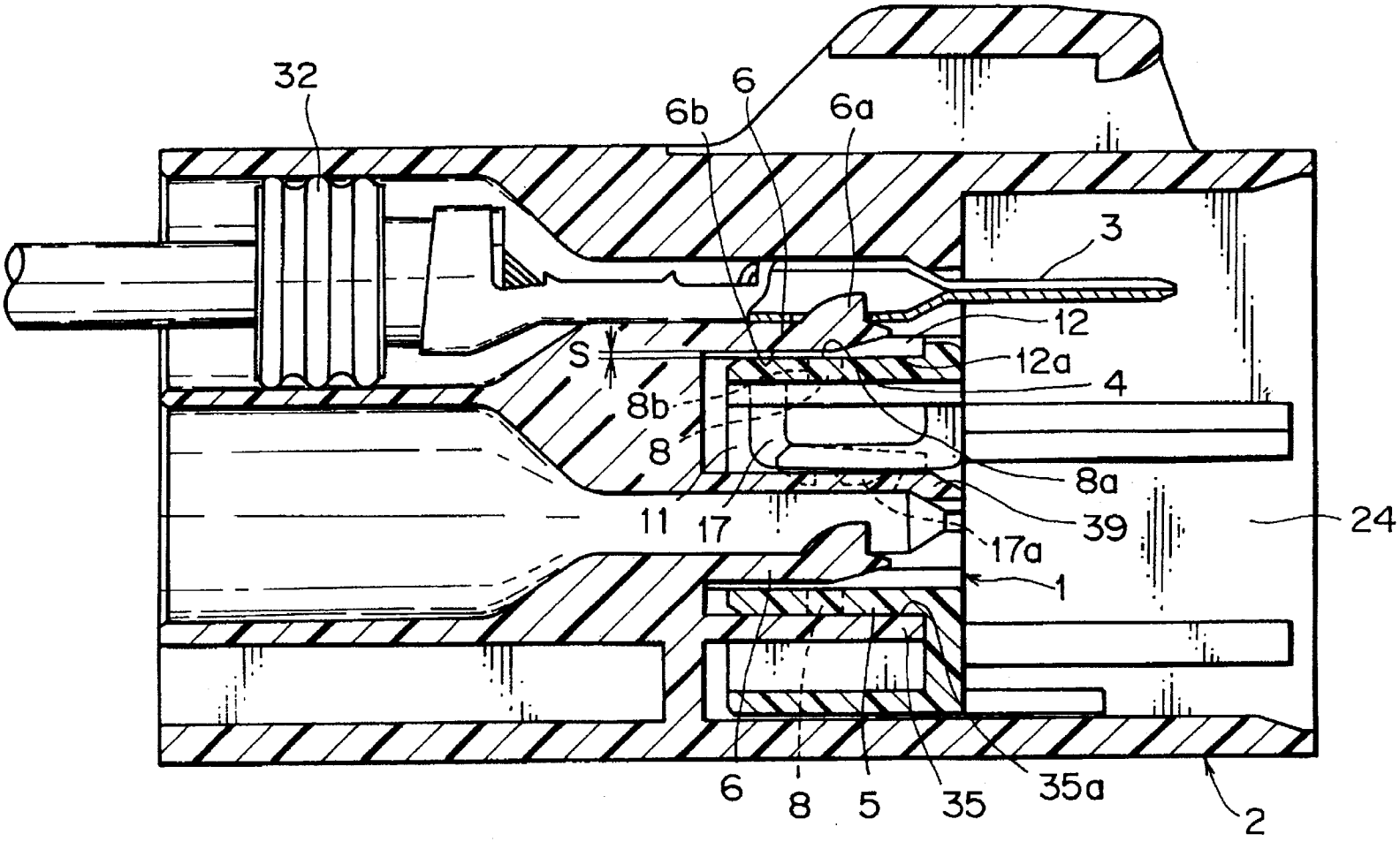
FIG. 5 is a longitudinal sectional view in which the holder is secondarily locked within the connector housing.
Figure 6:
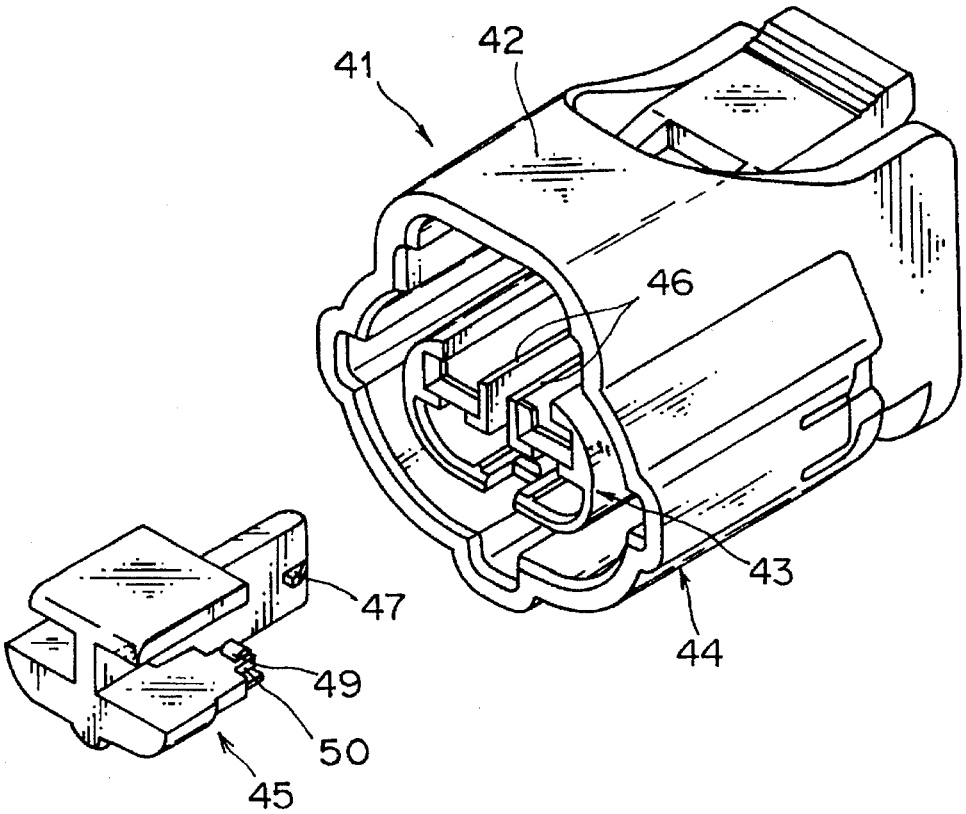
FIG. 6 PRIOR ART
FIG. 6 is an exploded perspective view of a conventional holder-containing connector.
Figure 7:
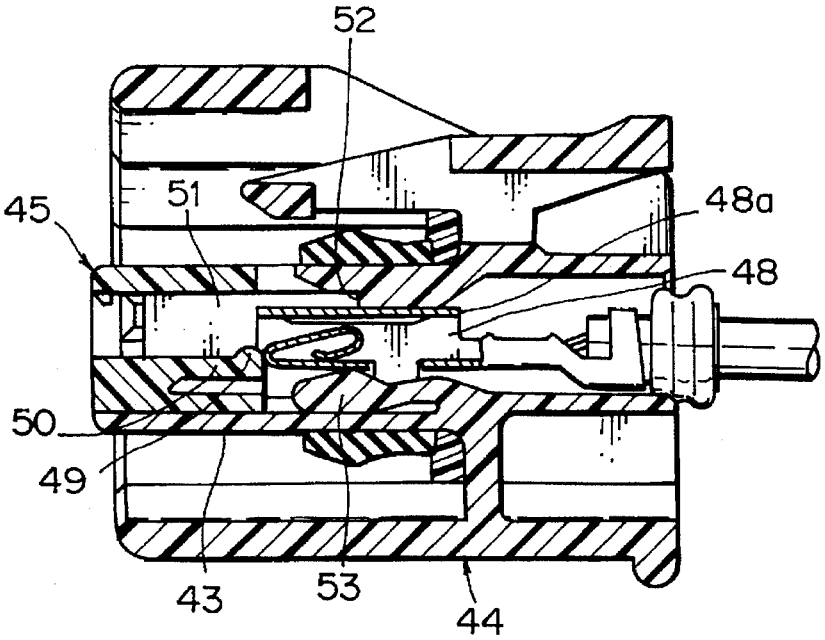
FIG. 7 PRIOR ART
FIG. 7 is a longitudinal sectional view in which an operation of the holder of the conventional holder-containing connector is shown.

In FIGS. 1 and 2, there is shown a front holder, and in FIGS. 3 to 5, there is shown a holder-containing connector C in which the front holder is installed in a female connector housing.

The front holder 1 is made of a synthetic resin material and comprises a pair of receiving grooves 7 and a pair of deflection prohibiting members 8 with respect to a resilient locking lance 6 provided under each terminal, which are mounted respectively on an upper plate 4 and a lower plate 5 for receiving respectively two male terminals 3 for each of these vertically aligned plates within a female connector housing 2. The upper and lower plates 4 and 5 are interconnected by way of a pair of resilient sections 10 respectively provided in the central portion of opposite side walls 9.

As shown in FIG. 1, the receiving groove 7 is formed in the front half portion of each of the plates 4 and 5, wherein the front end thereof is made open at the front end portion of the holder, whereas the rear end thereof is made as a continuation to the deflection prohibiting member 8. The upper surface 8*a* of each plate (to be abutted against the resilient locking lance) resides on the same surface as the respective upper surfaces 18, 19 of the plates 4 and 5. The upper wall surface 18 (external wall surface) of the upper plate 4 functions as an abutting surface to be fitted with an inner side surface 12*a* of an upper guide wall 12 of a holder fitting section 11 formed in the connector housing 2 (explained later on). Behind the deflection prohibiting member 8, or the rear half of the respective plates 4 and 5 there is provided a jig insertion groove 13 for releasing the fitting of the resilient locking lance 6, and at the rear end of each of the plates 4 and 5 there is provided an upright flange 14 that functions as a stopper to be abutted against the front end of the holder fitting section 11 in the connector housing 2.

The each resilient section 10 is formed in the central portion of the respective opposite side wall surfaces 9 whose thickness is a bit thinner than that of the upper and lower plates 4 and 5, and protruding toward the inner side of the holder in substantially a semi-circular shape. The resilient section 10 is urged in the direction for separating these plates 4 and 5 from each other, and is deformed to be shrunk when the two plates are pressed in the direction for accessing to each other. The resilient section 10 is set in a substantially semi-circular or an arc shape when it is in the normal state (not applied any pressurizing force thereto), and is deformed into a substantially U-shape when it is pressed inwardly of the holder 1.

Within the inner side of the holder 1, there is formed a space 40 (FIG. 2) of a substantially rectangular shape enclosed among the upper and lower surfaces 4 and 5 together with the opposite side walls 9, and a lower terminal accommodating chamber 15 of the connector housing 2 threads through the thus formed rectangular space 40 as shown in FIGS. 3 to 5. On the lower side surface of the upper side plate 4 within the same space 40, a preliminary locking arm 16 and a secondary locking arm 17 are protrudedly formed for thereby locking the connector housing. The preliminary locking arm 16 is extended from the rear end of the holder 1 to the front end thereof, whereas the secondary locking arm 17 is, on the contrary, extended from the front end of the holder 1 to the rear end thereof. These locking arms 16, 17 are formed respectively with a locking projections 16*a* and 17*a*.

On the other hand, the lower wall surface 20 (external wall surface) of the lower plate 5 functions as an abutting surface with respect to a lower guide wall surface of the holder fitting section in the female connector housing. A pair of abutting surfaces 20 are formed each on the lateral outer side of the lower plate 5, and each one is formed as a continuation to a protrusion 21 (FIG. 2) making a right angle therewith. Formed below the lower plate 5 in continuation thereto is a bottom surface 22 (FIG. 2) facing along the inner wall of the connector housing 2, and in the central portion of a skirt wall 23 connecting the lower plate 5 and the bottom wall 22, there is formed a through hole 26 for receiving a protruding rod 25 (FIG. 3) within a connector receiving chamber 24 of the female connector housing 2, and formed directly below the through hole 26 is a hook-like operation rod 27 for a pushing and/or a drawing operation of the holder. The protruding rod 25 functions as a positioning guide for properly setting the holder 1 and an opposing male connector housing (not shown).

FIG. 3 shows a state that the front holder 1 is preliminarily locked (in a semi-engaged state) with the female connector housing 2, wherein the front half of the holder 1 is inserted into the holder fitting section 11 of a substantially rectangular shape formed substantially along the housing peripheral wall 28 as shown in FIG. 4 at the rear portion of the connector receiving chamber 24 of the female connector housing 2, and fitted with a projection 16*a* of the preliminary locking arm 16 at a preliminary locking section of the opposing housing (not shown). In this state, the receiving grooves 7 of the plates 4 and 5 of the holder 1 are positioned in the deflection absorbing space under the resilient locking lance 6 set at the lower position of a terminal accommodating chamber 29 of the connector housing 2, and the locking lance 6 is enabled to deflect into the receiving groove 7. Then, the male terminal 3 is inserted into the terminal accommodating chamber 29 from the rear side, and the terminal 3 is locked by the locking lance 6. The terminal 3 is provided with a water-proofing rubber plug 32 at the rear section thereof.

In FIGS. 3 and 4, the inner surface 12*a* of the upper guide wall 12 of the holder fitting section 11 is horizontally extended from the locking lance 6 to the housing side wall 28 in the lateral direction of the upper resilient locking lance 6, which is the direction intersecting with the locking lance deflecting direction. This upper guide wall inner surface 12*a* is formed on each of the lateral outer sides of the housing 2, and each one is set at a bit lower than the deflecting lower surface 6*b* of the locking lance 6. The upper guide wall inner surface 12*a* is formed in continuation to a side surface 29*a* of the terminal accommodating chamber 29 making a right angle therebetween. An inner surface 33 of the holder fitting section between the laterally opposite locking lances 6 is set higher than the lower surface 6*b* of the locking lance 6, so that it is not brought into contact with the upper surface of the upper plate 4 of the holder 1.

In the connector housing 2 close to the bottom wall 34, there are formed a pair of lower guides 35, 35 facing to the pair of upper guide walls 12, 12 of the holder fitting section 11. Further, the upper wall surface 36 of the lower plate 5 of the holder 1 is positioned facing to the lower surface 37*a* of an intermediate guide wall 37 of the holder fitting section 11. The intermediate guide wall 37 is set having a gap S away from the locking lance 6 just likely as the upper guide wall 12, and the lower plate 5 is inserted between the intermediate guide wall 37 and the lower guide wall 35. The distance A1 between the upper and lower plates 4 and 5 of the holder 1 at the free state thereof shown in FIG. 2 is, as shown in FIGS. 3 and 4, made longer than the distance B1 between the upper guide wall 12 of the connector housing 2 and the intermediate wall 37 (same as the distance between the upper and lower locking lances 6), which means that the distance A2 between the plates 4 and 5 is made a bit longer than the distance B2 between the upper guide wall 12 and the lower guide wall 35.

In this structure above, either by inserting the holder 1 being pressed vertically into the holder fitting section 11 or by slidably shifting the beveled surface 38 of the front end of the respective plates 4 and 5 along the front end of the respective upper and lower guide walls 12 and 35, and inserting the holder 1 being vertically pressed along these guide walls 12 and 35, the upper plate 4 and the lower plate 5 are urged by the recovering force of the resilient section 10 of the holder 1 respectively to the upward and downward, whereby the external surface (abutting surface) 18 of the upper plate 4 is abutted against the inner surface 12*a* of the upper guide wall 12 of the holder fitting section 11, and the external surface (abutting surface) 20 of the lower plate 5 is abutted against the inner surface 35 of the lower guide wall 35 of the holder fitting section 11, thereby to secure the stability of the holder 1 within the connector housing 2.

By this operation, in the state that the holder is fully inserted into the holder fitting section 11 (to be held in the secondary locked position) as shown in FIG. 5, the gap between the lower surface 6*b* of the resilient locking lance 6 and the upper surface 8*a* of the deflection prohibiting member 8 of the respective holder plates 4 and 5 (in other words, the gap S between the locking lance 6 and the abutting surface 8*a* of the respective plates) is constantly maintained. With the holder 1 being locked in the secondary locked position, the deflection prohibiting member 8 of the respective plates 4 and 5 is held directly below the locking lance 6. This secondary locking is conducted when the projection 17*a* of the secondary locking arm 17 of the holder 1 gets over the fitting projection 39 of the housing 2.

In the event that the terminal 3 is not in the fully inserted state, the front end 8*b* of the deflection prohibiting member 8 of the holder 1 abuts against the front end of the locking lance 6, and thus it cannot be pushed further and accordingly an imperfect insertion of the terminal is thereby detected. In this situation, in case the terminal 3 is in the fully inserted state, even if there is a variation in the dimensions of each of the housing and/or holder due to the molding process thereof, since the deflection prohibiting member 8 is directly below the locking lance 6 with a regulated constant subtle gap S, the deflection of the locking lance 6 is securely prevented and thus the terminal is securely locked.

Further, as the determination of the fitting dimension between the connector housing 2 and the holder 1 is made easy, number of procedures to be considered for fabrication of the products is also greatly reduced. It is to be noted that the gap between the locking lance 6 and the deflection prohibiting member 8 can also be set to "0".

Still further, although the stability of the holder 1 is maintained due to the fact that the guide wall surfaces 12*a* and 35*a* are provided at opposite sides of the connector housing 2 respectively in pairs, the lower guide wall 35 can be substituted by a central protruding rod 25 (FIG. 4). In addition, although the above embodiment corresponds to a connector with two vertically aligned stages each having a pair of two horizontally aligned terminals 3, it can also be adapted to a connector having only one stage with a pair of two terminals 3 in such a manner that one plate 4 of the holder 1 prevents a deflection of the resilient locking lance 6, while the other plate 5 functions only as an abutting surface for receiving the guide surface 35*a* of the connector housing 2.

And still further, it is also possible to replace the preliminary locking arm 16 and the secondary locking arm 17 with another locking means, and the structure of the present invention is not limited to the front holder to be inserted from the front side of the connector housing, but a rear holder to be inserted from the rear side thereof can also be adopted, and moreover, it is applicable to a male connector housing instead of the female connector housing as shown in the present embodiment.

EFFECT OF THE INVENTION

As explained heretofore, since in the present invention a resilient portion of the holder is deflected, the holder can be readily inserted into the connector housing, and simultaneously the plate of the holder is pressed against the guide wall of the connector housing due to the recovering force of the resilient portion. By this operation, a gap between the resilient locking lance of the connector housing and the deflection prohibiting member of the holder plate is maintained to a constant short distance, whereby the deflection of the resilient locking lance is securely prevented and thus the terminal is securely locked. Further, even in the event that the terminal is not in a fully inserted state, as the holder is securely fixed, the end portion of the holder abuts against the locking lance and hamper the further movement of the holder, whereby it is detected that the insertion of the terminal is incomplete.

While the invention has been described with reference to specific embodiments, the description is illustrative and is not to be construed as limiting the scope of the invention. Various modifications and changes may occur to those skilled in the art without departing from the spirit and scope of the invention as defined by the appended claims.

What is claimed is:

1. A holder-containing type connector comprising:

a connector housing having a resilient locking lance for locking a terminal inserted therein, and a holder having a deflection prohibiting member which can move into a deflection absorbing space for allowing said resilient locking lance to deflect therein, and insertable into said connector housing, wherein said holder is composed of:

a pair of mutually facing plates each having said deflection prohibiting member, said pair of plates being connected by a pair of resilient sections and urged away from each other, and said connector housing comprises:

a pair of first and second guide walls each abutting against an external surface of each of said pair of plates, wherein a distance between said pair of plates is made longer than that between said guide walls.

2. A holder-containing connector as claimed in claim 1, wherein each of said pair of plates is formed with a groove for receiving said resilient lance, and said resilient lance can move into said groove when said holder is in a semi-engaged state with said connector housing, and is set adjacent said deflection prohibiting member while said holder is in a fully engaged state with said housing.

3. A holder-containing connector as claimed in claim 1, wherein said connector housing further comprises a third guide wall between said first and second guide walls for receiving the lower one of said pair of plates between said second and third guide walls.

* * * * *

UNITED STATES PATENT AND TRADEMARK OFFICE

CERTIFICATE OF CORRECTION

PATENT NO. : 5,647,764
DATED : July 15, 1997
INVENTOR(S) : Tomohiko KIMURA

It is certified that error appears in the above-identified patent and that said Letters Patent is hereby corrected as shown below:

On the title page of the patent item [73], the assignee is incorrect in that the city and country have been omitted. Please change the assignee, "Yazaki Corporation" to be --Yazaki Corporation, Tokyo, Japan-- therefor.

Signed and Sealed this

Fourteenth Day of April, 1998

*Attest:*

*Attesting Officer*

BRUCE LEHMAN

*Commissioner of Patents and Trademarks*